US007572520B2

(12) United States Patent
Surber

(10) Patent No.: US 7,572,520 B2
(45) Date of Patent: Aug. 11, 2009

(54) TROPHY CONSTRUCTION

(76) Inventor: Jerry Surber, 4108 Glenbrook Ct., Houston, TX (US) 77087

( * ) Notice: Subject to any disclaimer, the term of this patent is extended or adjusted under 35 U.S.C. 154(b) by 101 days.

(21) Appl. No.: 11/040,844

(22) Filed: Jan. 21, 2005

(65) Prior Publication Data

US 2006/0046085 A1 Mar. 2, 2006

(51) Int. Cl.
*A47G 35/00* (2006.01)

(52) U.S. Cl. ..... 428/542.4

(58) Field of Classification Search ..... 428/542.4, 428/7, 12, 31; 248/176.1; 411/551, 21, 546, 411/354, 353, 549; 403/118
See application file for complete search history.

(56) References Cited

U.S. PATENT DOCUMENTS 3,027,670 A * 4/1962 Kramer et al. ..... 428/542.4
3,595,727 A 7/1971 Allen
3,754,724 A 8/1973 Osowski
4,323,630 A 4/1982 Mackey
5,088,153 A * 2/1992 Winder et al. ..... 16/108
5,322,739 A * 6/1994 Stagl ..... 428/542.4
6,828,034 B2 12/2004 Banman

* cited by examiner

*Primary Examiner*—Timothy M Speer
*Assistant Examiner*—Gordon R Baldwin
(74) *Attorney, Agent, or Firm*—Timothy F. Mills

(57) ABSTRACT

An apparatus and method therefore of utilizing a connector base of the present invention to preconstruct a trophy assembly prior to the attachment of the figure, utilizing traditional threaded rod construction, with the connector base further adapted to receive one or more additional components configured with a resilient or rigid attachment, such as a figure, to complete the trophy for use. More particularly, the figure may have a traditional threaded stud molded therein, or be adapted to snap or twist in place establishing a permanent connection, or reversibly twist or snap in place. In addition, the attachment comprises a resilient or rigid connecting member attached to a trophy component adapted to insert into a connector member opening configured in a second trophy component. Further, any component of a trophy assembly could be adapted with the snap or twist attachment of the present invention and the assembly could quickly proceed without the need for the internal threaded rod. Further, a method of business providing preconstructed trophy assemblies to the industry is stated.

10 Claims, 13 Drawing Sheets

22
42
36
48
38
40
52
50
41
36
51
46
EXPLODED VIEW
20
44
TOP VIEW
20

36
44
34
TOP VIEW
34b
34a

TROPHY CONSTRUCTION

BACKGROUND OF THE INVENTION

The present invention relates generally to the field of trophy assembly and construction, more particularly to components that can be more rapidly secured together to facilitate more rapid construction. In other aspects the invention relates to components that can be more rapidly assembled or disassembled by utilizing connectors that reversibly engage components. Thus components may be designed to snap together, reversibly come apart, or utilize a snap or twisting motion to engage and disengage. In other aspects the invention relates to using one or more types of connectors on one or more of the trophy components, including a connector base of the present invention, to utilize multiple types of connectors to facilitate rapid construction.

For example, a trophy may comprise a base, riser and or stem, and a top or cap with one or more decorative extrusions/injections placed between, and a figure, award or other design mounted thereon. The base may also include only a figure or other award design thereon. The figure or award design is typically a three dimensional model of a representative sporting element like a soccer ball, a cheerleader, an auto, or other emblem representative of a particular activity. The trophy construction is typically secured by a threaded rod extending through the individual parts of the entire assembly which directly or through use of a nut, sleeve or ferrule retains the figure in position.

Inexpensive trophies are conventionally made with extruded and/or injection molded plastic or metal parts. Typically the riser, extrusions and figure are made of injection molded plastic with a gold or silver appearance. The decorative extrusion may also be plated or foiled attractively to enhance the appearance of the trophy.

The generally accepted and traditional method of securing the award or figure to the trophy is by a threaded stud extending from the figure, which is screwed into a ferrule attached to a threaded rod. The threaded rod is then used to secure the parts together into a final product. To provide the figure with a threaded stud, during the injection process a metal screw or bolt is placed in the mold first before the material is injected. Once cured, the figure is extracted from the mold with the threaded stud in place. The piece may then proceed to coloring prior to inventory. In order to maintain quality and interest buyers, the figure, riser and other parts are generally manufactured separately.

Production of the molds is a very expensive process for the manufacturer. Each figure requires a separate mold and there are hundreds of figures available on the market. To reduce the need to produce new molds to take advantage of the present invention, an adapter comprising the features of the present invention is provided to screw onto the pre-existing threaded stud of the award. The adapter then functions to enable the rapid connection advantage of the present invention by allowing figures with threaded studs to be adapted to the preassembled trophy of the present invention. The preassembled trophy having the mating connector in place. The adapter could be made of a substantially rigid or substantially resilient material. Any place there is a protruding connecting member from a trophy part, an adapter of the present invention may be fashioned to take advantage of the rapid connection of the present invention. For example the protruding member could be threaded, splined, keyed, knurled, smooth or of other geometry sufficient to provide surface area for attachment of such an adapter.

In prior art constructions, it was normally necessary to identify the use of the trophy prior to construction, in order to place an order for a figure appropriate to the need. This requires that all the components of a trophy are kept in inventory waiting for assembly. Once the order is received from the customer, the retailer must then order all of the individual parts and assemble them. The retailers do not typically have large numbers of parts on hand but instead rely upon quick delivery methods to obtain the parts from a supplier and then assemble the trophy on site. However, the supplier must keep large numbers of individual parts on hand to meet any demand. Thus the supplier has increased costs for inventory and the retailer has increased costs of labor for assembly. From the time the customer places the order until completion and delivery can be many hours, a week or more. The advent of just-in-time order and delivery has made the rapid construction of trophies from individual parts a necessity. Retailers demand it from suppliers since customers are placing an increased demand for a quick turn-around time based upon their needs.

U.S. Pat. No. 3,027,670 (1960) attempted to avoid the problems associated with a threaded figure attachment by providing a simple device for mounting a FIG. 16 on a preconstructed trophy base 14 in a secure manner insuring against inadvertent removal. '670 addressed this problem by use of an adapter bushing 42 with a smooth bore 49 secured to a threaded elongated bolt 32. Said adapter bushing 42 was designed to accept a split sleeve fitting 48 placed around the figure threaded bolt 20 to cover the threads. Thus rotational force was minimized or eliminated upon attachment of the FIG. 16. The FIG. 16 was held in tight-fitting non-rotational relationship with the bore 49 of the bushing 42 by tongues 58 constructed with crimps 64 and an outwardly turned edge 60 to frictionally engage the side of the bore 49. However, one disadvantage of this arrangement was that in order to change the FIG. 16 it was necessary to disassemble the trophy and disengage the fitting 48 after removal of the elongated bolt 32 from the bushing 42. '670 provided a relatively rapid method for placing, but it was not removable without disassembly and thus did not reduce the amount of time or effort needed to remove or replace the figure. Because of these disadvantages it was never widely used in the industry and is not available today.

U.S. Pat. No. 3,595,727 (1967) provided a selectable parts trophy body construction based upon a cup-shaped body member 11 in the preferred embodiment. Said body member 11 was reversibly attached to an upper adapter member 14 by use of tongue 47 and groove 46 elements, and to a lower adapter member 14 by tongue 71 and groove 72. However, the figure and base were attached using the standard threaded stud or bolt construction. Thus '727 provided a convenient way of interchanging trophy body parts that could be shaped to incorporate exterior tongue and groove fasteners, but did not address the problem of the construction noted above where the body parts were connected by a central threaded bolt. Because of these disadvantages it was never widely used in the industry and is not available today.

U.S. Pat. No. 5,322,739 (1994) illustrated the use of resilient locking fingers 58 of plastic material on a trophy lid 18 to engage slots 56 in a riser 14 to simplify trophy construction where separate risers 14 and die cast lids 18 could be easily and securely connected together. However, '739 continued to rely upon a threaded sleeve 30 attached to the usual central threaded rod member 24 to mate with the threaded projection 42 of the figurine 22 and retain it in place. '739 did not use or claim said locking fingers 58 to attach any parts other than the lid and riser. Although a lid is shown and claimed between the decorative extrusion 16 and the figurine 22, the only retaining mechanism employed to hold the lid on the extrusion, and the figurine on the lid, was the threaded rod member 24, not resilient locking fingers 58. Thus '739 teaches only that trophy lids and risers can be aligned quickly and easily by resilient locking fingers, but still require a threaded bolt to secure the assembly. Plus, the additional time and effort required to change a figurine or other trophy part secured by a threaded bolt was not improved. Because of these disadvantages it was never widely used in the industry and is not available today.

The prior art method is labor, cost and time intensive, obviating the need for more efficient trophy assembly. Another disadvantage is that it is common for suppliers and/or retailers to have to disassemble completed trophies because of order cancellation or the customer wants to change the figure. Then new parts must be procured and the assembly completed again by carefully aligning all of the parts before the threaded rod is tightened. The present invention provides the supplier or retailer the ability to buy completely preassembled trophies and then only have to attach selected risers and/or figures, or the remove the existing part and replace it.

Secondly, the present invention reduces the inventory requirements thus reducing cost and yet enhancing deliverability. For example, a base, column and connector may be preassembled by the manufacturer or supplier. The customer chooses the preassembled trophy and matches an appropriate figure. Upon receipt of these parts, typically by just-in-time delivery, the retailer can rapidly construct the finished trophy by attaching the figure to the pre-assembled trophy and the piece is ready for pick-up by the customer. It is also possible in the manner of the present invention that the retailer may carry certain popular preassembled trophies in inventory along with various rapid connecting figures, and/or other decorative parts, and complete the order while the customer waits. Thus the retailer does not have to incur the time and labor cost of assembly of all of the individual parts, and provides more rapid service to the customer. To further reduce cost the trophy assembly could be completed in a market with lower labor costs, and that cost saving could be passed along to the supplier and ultimately the consumer.

The configuration of the connecting member may provide a reversible or non-reversible connection. One example of a reversible connecting adaptation is the use of twist and lock elements that reversibly engage. Any of the connecting members of the present invention may be configured to reversibly or non-reversibly engage. In addition, the various types of connectors of the present invention could be configured on any trophy component. Thus, a trophy could be completely preassembled by using these connectors on each component without the traditional centrally threaded rod.

For those manufacturers who do not want to incur the cost of new molds for their many figures, yet desire to take advantage of the rapid connection feature of the present invention, an adapter and base connector as described above could be quickly employed.

To further increase the options for manufacture or assembly, the connector base already configured to receive the rapid connection could be configured to have a central bore into which either a threaded nut, bolt or insert could be located to receive one end of the prior art threaded bolt. An advantage of such a configuration allows the manufacturer or assembler to decide at the time of assembly whether to use a nut, bolt or other insert depending upon the availability of parts, design, cost or other deciding factor.

With the present disclosure it is now possible to have on hand a preassembled trophy which a supplier or retailer may easily modify into a wide variety of trophies using only a limited number of parts.

It is therefore apparent that there is a need for an improved way to assemble or construct trophies and it is an object of this invention to provide an apparatus and methods of construction and doing business to meet these needs.

It is also an object of the present invention to provide a simplified construction in which separate risers, extrusions, and figures can be easily and securely connected together without the use of a threaded bolt.

It is further object of the present invention to provide a simplified construction of trophy parts where alignment of the parts may be preconfigured by the positioning of the connecting member and the mating receptacle.

It is a further object of this invention to provide apparatus to adapt trophy construction having threaded type connectors to rapid connection configuration to take advantage of the features of the present invention.

It is a further object of this invention to provide a method of business of supplying a trophy comprising a preassembled trophy construction including a rapid connector of the present invention, and a rapid connecting riser and/or figure or other decorative part of the present invention.

Other objects and advantages of the present invention will be made clear to those skilled in the art by the following description of the presently preferred embodiments thereof.

SUMMARY OF THE INVENTION

These objects are achieved by providing an apparatus and a method for securing the various parts of trophies during assembly. In accordance with the invention, the apparatus comprises a mounting surface such as a connector base of the present invention, on which a riser and/or a figure rest, and at least one opening formed in the mounting surface. At least one resilient connecting member is molded into the riser or figure. As there could be more than one connecting member, each connecting member has, at its free end, a portion that is adapted to engage one of the slots in the mounting surface to urge locking. The riser also has at least one slot formed in a mounting surface on its top. The connecting member can be designed so that it can be pushed-in, snapped-in, clipped-in, twisted-in or otherwise engaged to secure the appropriate part. Furthermore, an adapter configured in accord with the present invention may be employed in a similar fashion to connect or facilitate connection between similar or dissimilar individual trophy parts.

DETAILED DESCRIPTION OF THE PREFERRED EMBODIMENT

Figure 1:
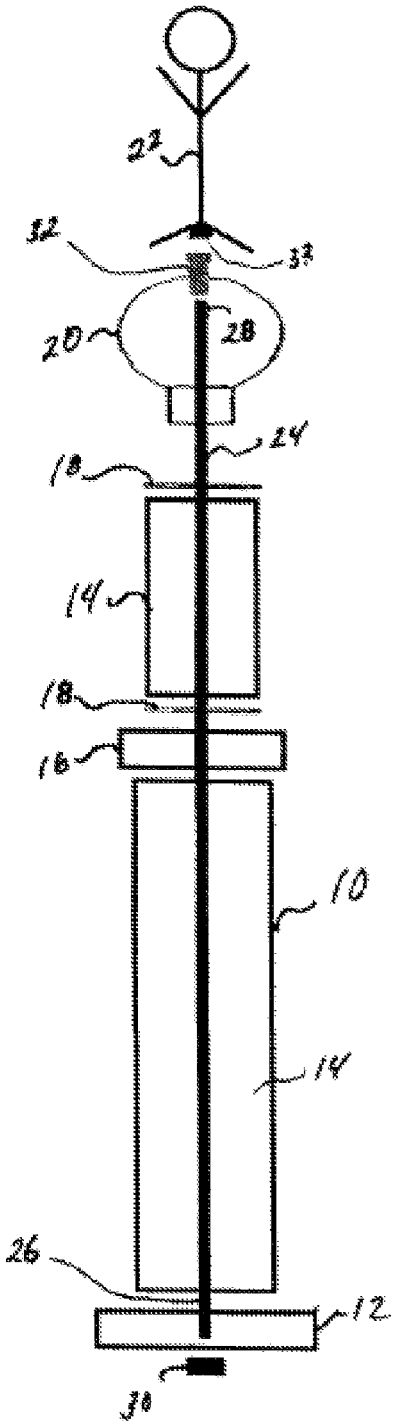
FIGURE 1 PRIOR ART
FIG. 1 is an exploded sectional view of a trophy incorporating the common construction of the prior art.
Figure 22:
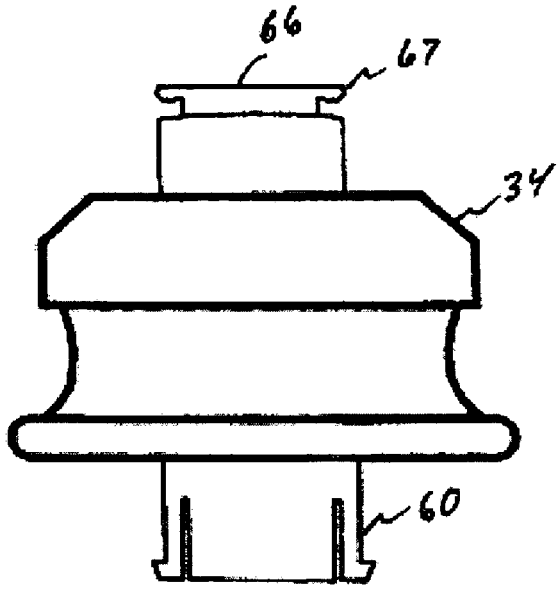
Figure 23:
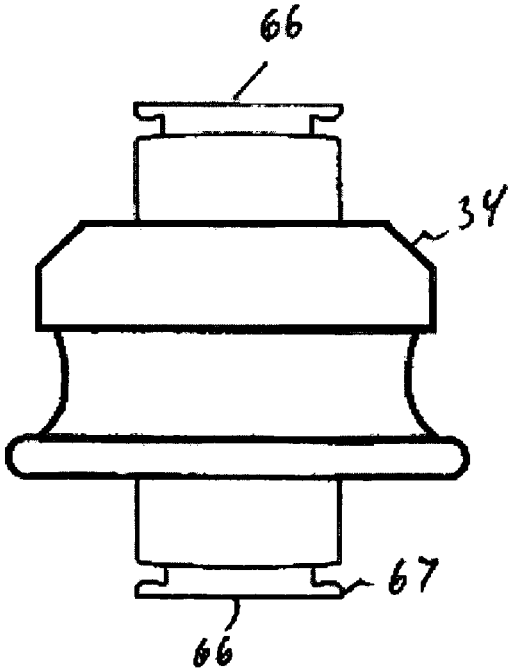
Figure 24:
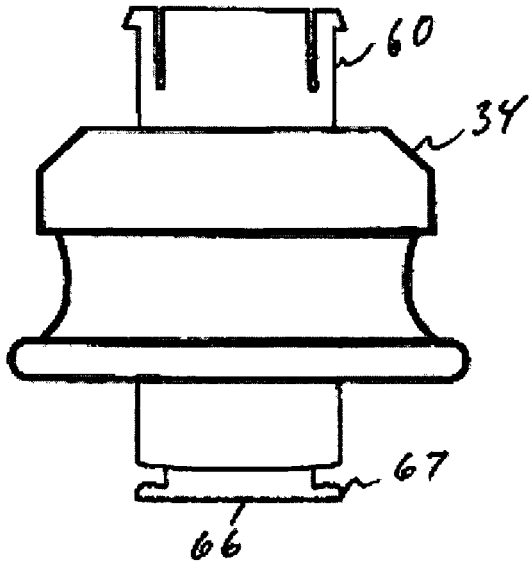

Referring first to FIG. 1, there is shown a drawing of the common construction of a trophy of the prior art. Numeral 10 indicates generally a trophy comprising a base 12 and figure 22 separated by decorative elements comprising one or more columns 14, spacers 16, caps or plates 18 and risers 20. Said elements are held in position in relation to one another by a screw threaded rod member 24 having a first end 26 secured through a base 12 by nut 30 and a second end 28 secured through a riser 20 by ferrule 32. The figure 22 is connected to the trophy 10 by a threaded member 33 which reversibly threads into the ferrule 32. Said construction requires that the use of the trophy 10 be identified prior to construction and may require that all the components be kept in inventory waiting for orders. If the trophy figure 22 or riser 20 needs to be changed the trophy 10 must be disassembled, the new parts inserted and aligned, and then the components reassembled. This is a time consuming and exacting process. Removal and replacement of just the figure 22 may cause the ferrule 32 to unthread from the rod member 24 resulting in the same problem as complete disassembly above.

In accordance with the present invention an apparatus is provided to reliably connect trophy parts such as riser or award without the need for a centrally threaded bolt.

Figure 2:
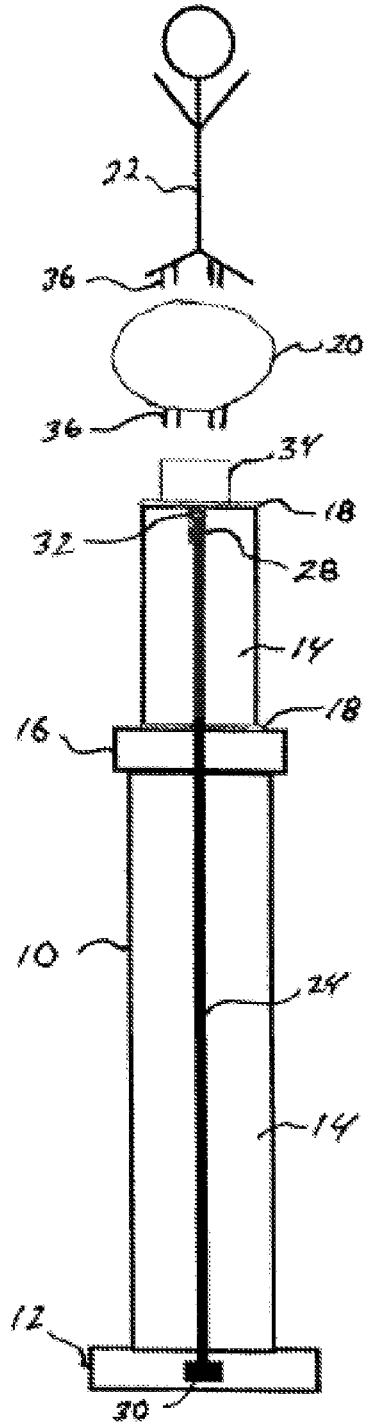
FIG. 2 is an exploded sectional of a trophy according to the present invention.

Referring to FIG. 2 of a preferred embodiment of the present invention, the trophy 10 comprises a base 12, columns 14, spacers 16, caps 18, and connector base 34. Connector base 34 preferably disposed in a cylindrical shape comprising an upper surface 34*a*, a lower surface 34*b*, and a substantially cylindrical body 34*c*. Said components are secured by a centrally threaded rod member 24 utilizing a nut 30 and ferrule 32 arrangement as shown in FIG. 1. In one embodiment, ferrule 32 is attached to cap 18, and therefore connector base 34 is attached to cap 18. In an alternative embodiment of FIG. 2, the connector base 34 is configured to incorporate the cap 18 as lower surface 34*b* and ferrule 32 directly in place of the separate components. Thus the lower surface 34*b* engages the upper edge of column 14.

FIG. 2 further illustrates that according to the teachings of the present invention a pre-trophy assembly, comprised of the basic components of at least a connector base 34 of the present invention and a base 12, may be pre-assembled using the central threaded rod method well known in the art. This assembly is then available to receive on the connector base 34 any variety of figure 22 and/or other decorative components, such as riser 20 of FIG. 6. Basically any component, or series of components, configured to attach via one or more securing members 36 of the present invention, may be quickly attached in the order desired.

Figures 3, 4:
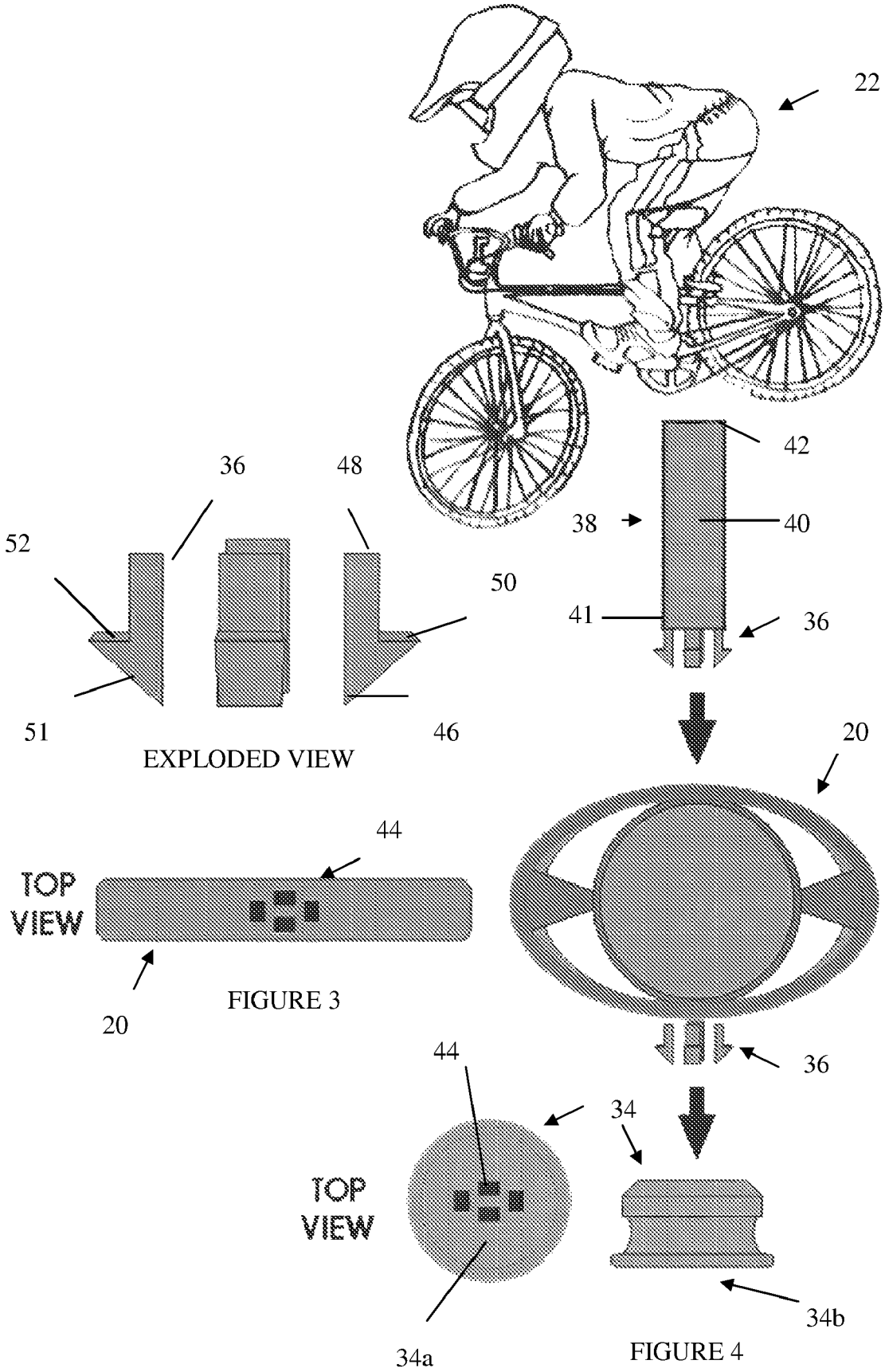
FIGS. 3, 4, 8, 9 and 10 are perspective views showing various embodiments of the resilient locking member according to the present invention.
Figure 11:
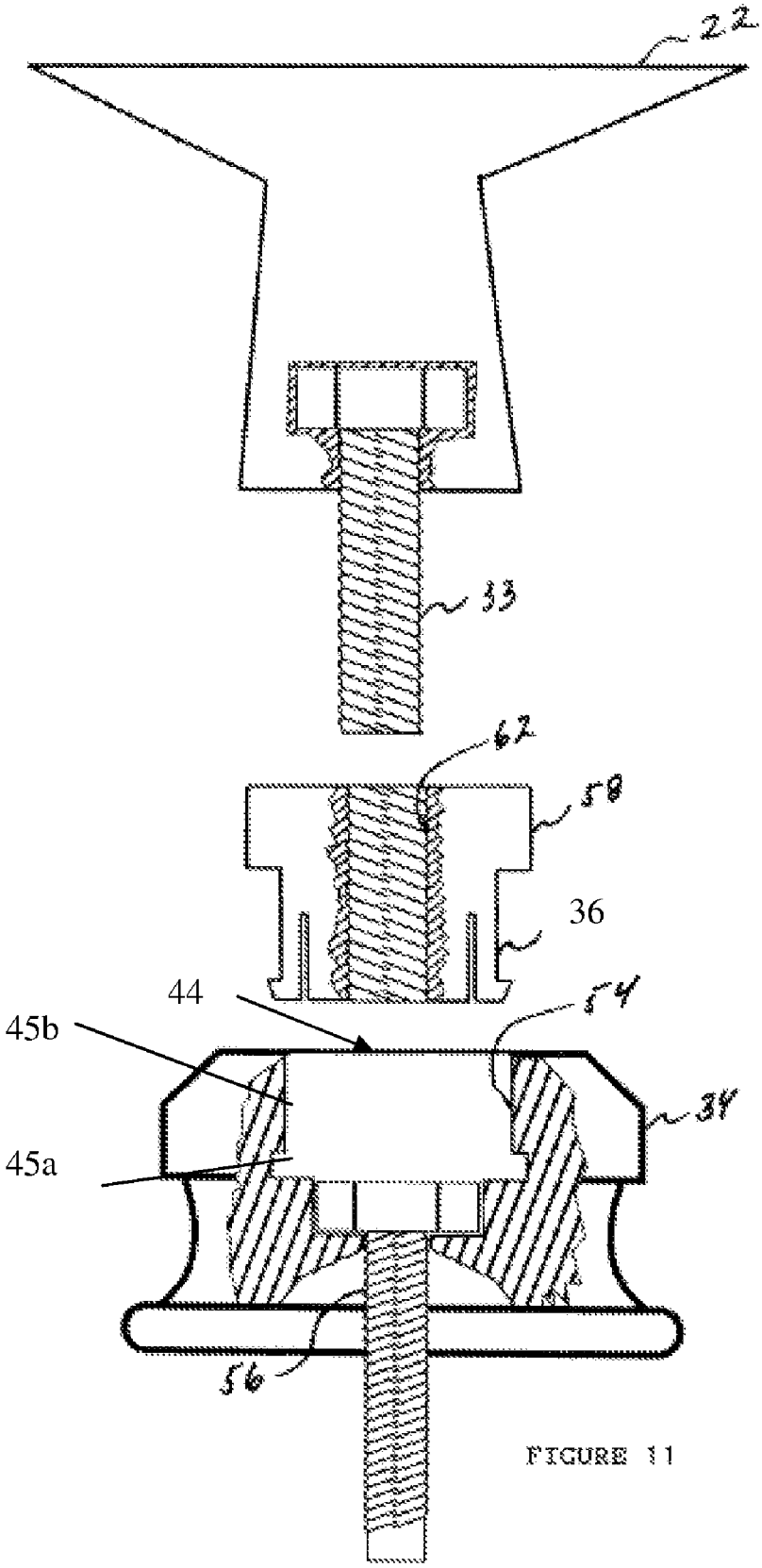
FIG. 11 thru 13 are perspective views showing embodiments of the connector base and adapter utilizing a threaded bore.
Figure 12:
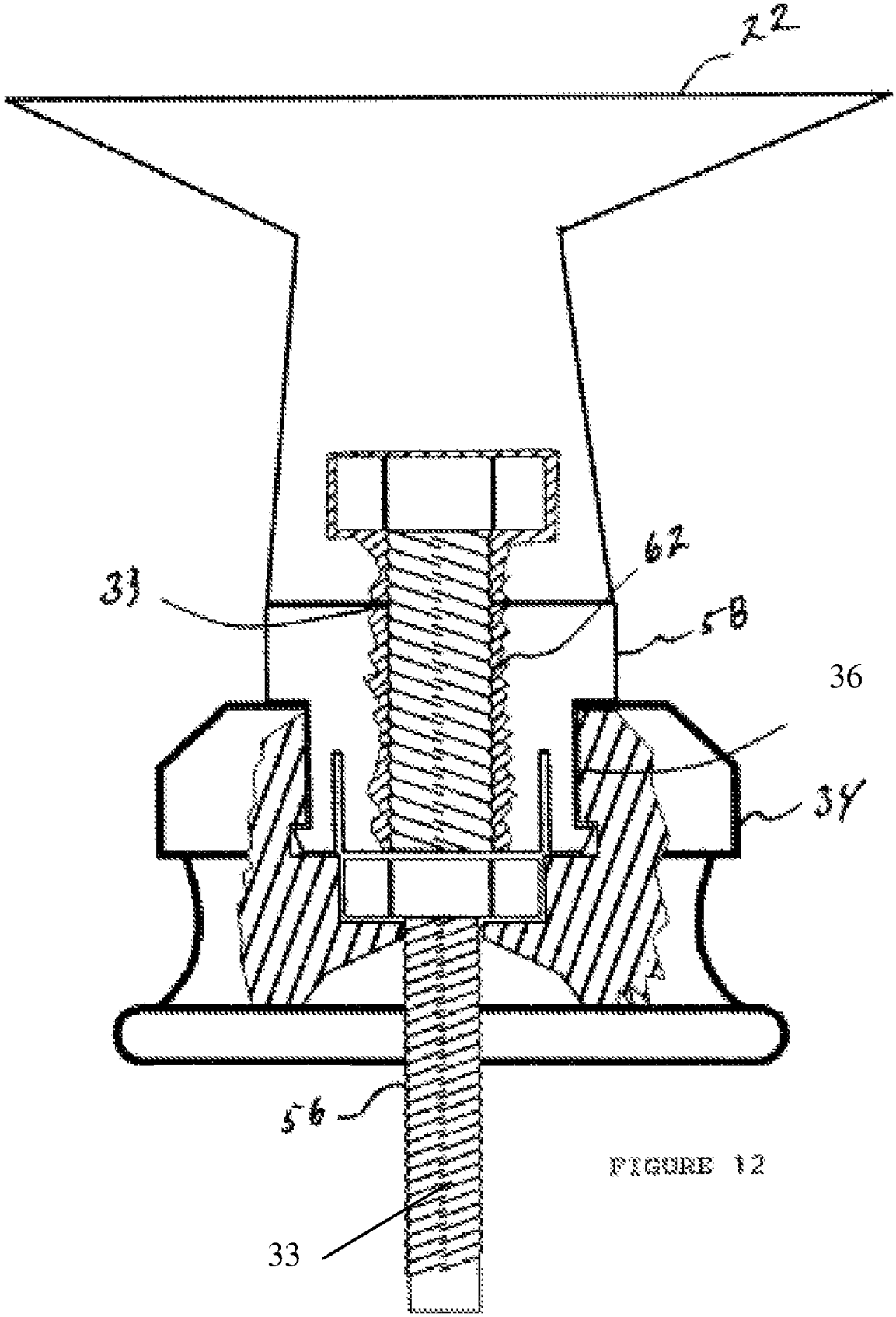

For example, trophy 10 of FIG. 2 comprises riser 20 and figure 22 having one or more securing members 36 which cooperate with one or more securing member openings 44 disposed in the upper surface 20*a* of riser 20 to engage the securing members 36 upon insertion thus placing the FIG. 22 in operative association with connector base 34. The securing members 36 of FIG. 3 comprising a first end 46, a second end 48, a projecting portion 50, a longitudinally-outward projecting camming surface 51, formed at a substantially acute angle to the plane of the connecting member 38, an engagement surface 52 formed at substantially ninety degrees to the plane of the connecting member 38 adapted to engage the bottom edge 45*a* of wall member 45*b* within securing member opening 44, as shown in FIGS. 11 and 12. The camming surface 51 extends outward from the vertical plane of the first end 46 a sufficient distance to support engagement surface 52 extending beyond the perimeter of the opening 44. Thus the angular camming surface 51 facilitates the introduction of the resilient securing member 36 into the corresponding opening 44. To connect trophy parts utilizing at least one resilient securing member 36 and a corresponding securing member opening 44, the first end 46 is aligned within opening 44 and force is applied in a longitudinal direction urging connector member 36 into the respective opening 44. Following insertion of the first end 46 of the securing member 36 into the opening 44 the camming surface 51 engages the wall member 45*b* flexing the securing member 36 inwardly, until projecting portion 50 extends beyond the bottom edge 45*a* at which point securing member 36 returns to the un-flexed position and engagement surface 52 retainably engages bottom edge 45*a*. Such arrangement serves to securely retain the figure 22, or the connecting member 38, in a desired position within the opening 44, and in cooperative alignment with the trophy 10. The connecting member 38 comprising a center portion 40, a first end 41 and a second end 42, wherein said second end 48 of the securing member 36 is attached to the connecting member first end 41 and then the second end 42 of the connecting member 38 directly engages the figure 22, as in FIG. 4. In an alternative embodiment, the second end 48 is directly attached to the figure 22. In addition, FIG. 4 shows the placement of an intermediate component, a decorative riser 20, placed between the connector base 34 and the figure 22, with said decorative riser 20 adapted with one or more resilient securing members 36 and respective securing member openings 44. Such an embodiment illustrates that one or more components of a trophy construction may be adapted to take advantage of the teachings of the present invention.

Figure 5:
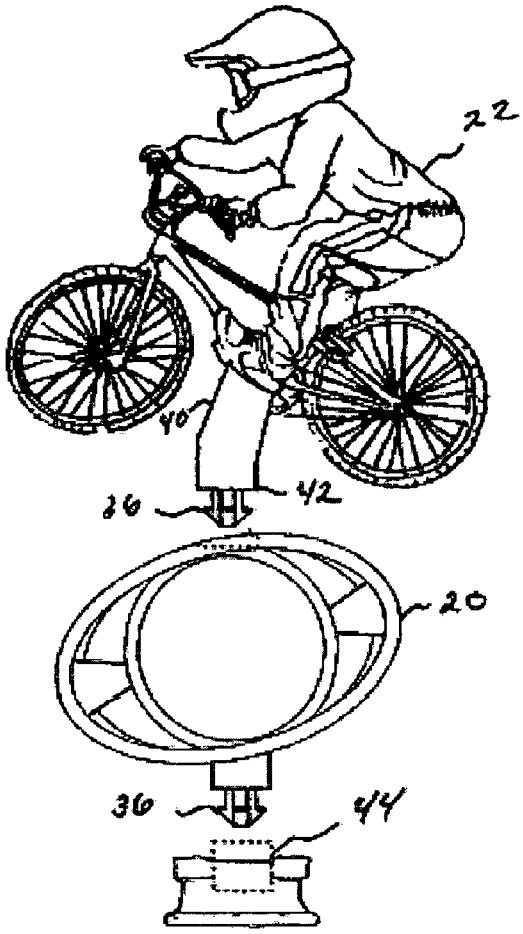
FIG. 5 is a perspective view of a figure, riser and connector base according to the present invention.
Figure 6:
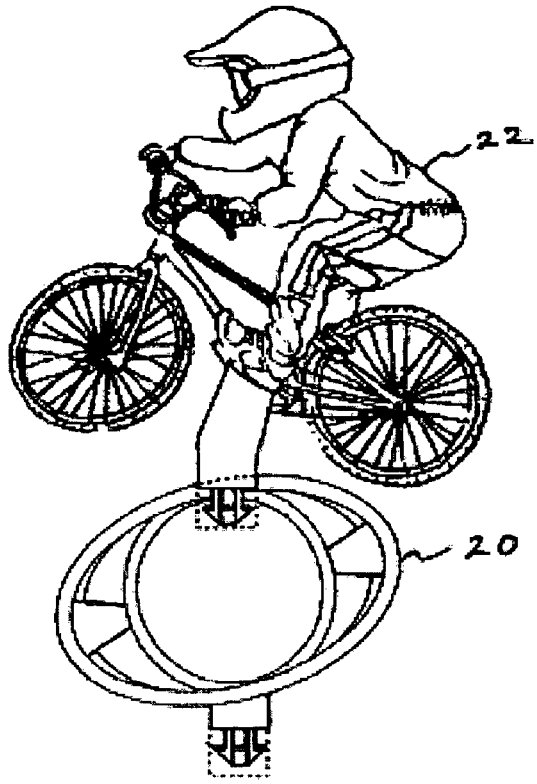
FIG. 6 is a perspective view of a figure and riser according to the present invention.
Figure 7:
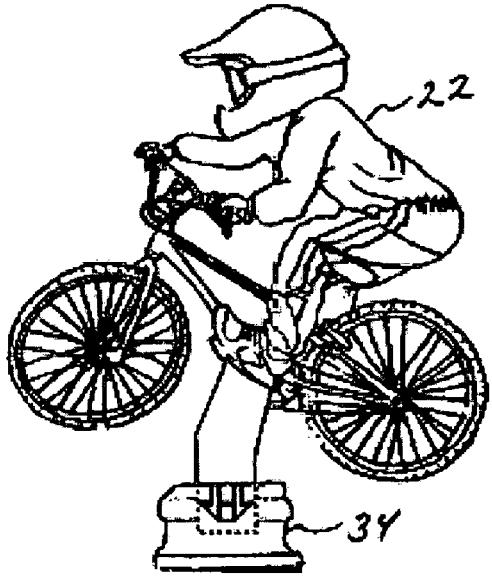
FIG. 7 is a perspective view of a figure and connector base according to the present invention.

In the alternative embodiments of FIGS. 5, 6 & 7 the securing member 36 is formed as one unit attached to a connecting member 38 with substantially opposed projecting portions 50 to engage said opening 44.

Figure 9:
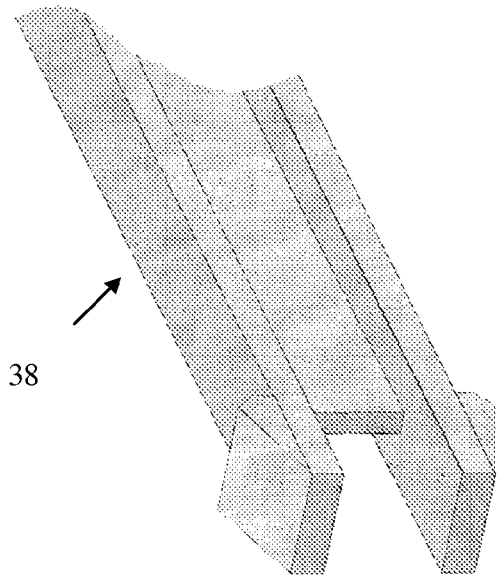
Figure 8:
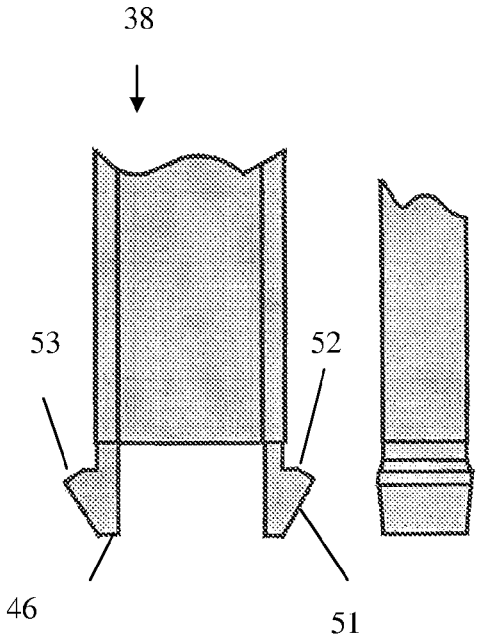
Figure 10:
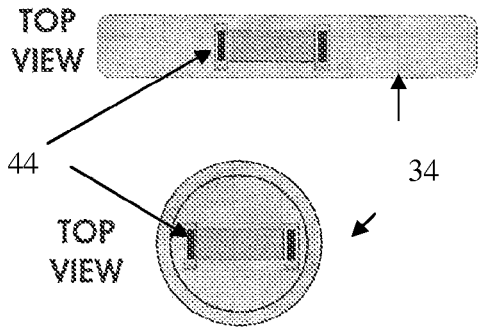

In the further alternative embodiments of FIGS. 8 & 9, a second longitudinally projecting camming surface 53 from engagement surface 52 of the securing member 36 is formed at an angle greater than ninety degrees from the plane of the connecting member 38 to facilitate disengagement from the bottom edge 45*a* of wall member 45*b* within securing member opening 44, by inwardly deflecting said securing members 36 to permit removal. One advantage of such a configuration is that the trophy part 22 may be reliably retained in the desired position by engagement surface 52, yet disengaged by sufficient upward longitudinal and transverse force exerted upon the trophy part 22 to cause the securing members 36 to flex, thereby allowing camming portion 53 to engage bottom edge 45*a* of wall member 45*b* and deflecting the resilient securing member 36 inwardly to disengage the bottom edge 45*a* and permit removal of trophy part 22. FIG. 10 illustrates a further alternative embodiment of securing member openings 44 in risers 20 or connector bases 34 adapted to reversibly engage securing members 36 of FIGS. 8 and 9. Thus, trophy parts of the present invention may be interchanged without the necessity of unthreading a screw threaded rod and disassembling the entire trophy 10.

Figure 13:
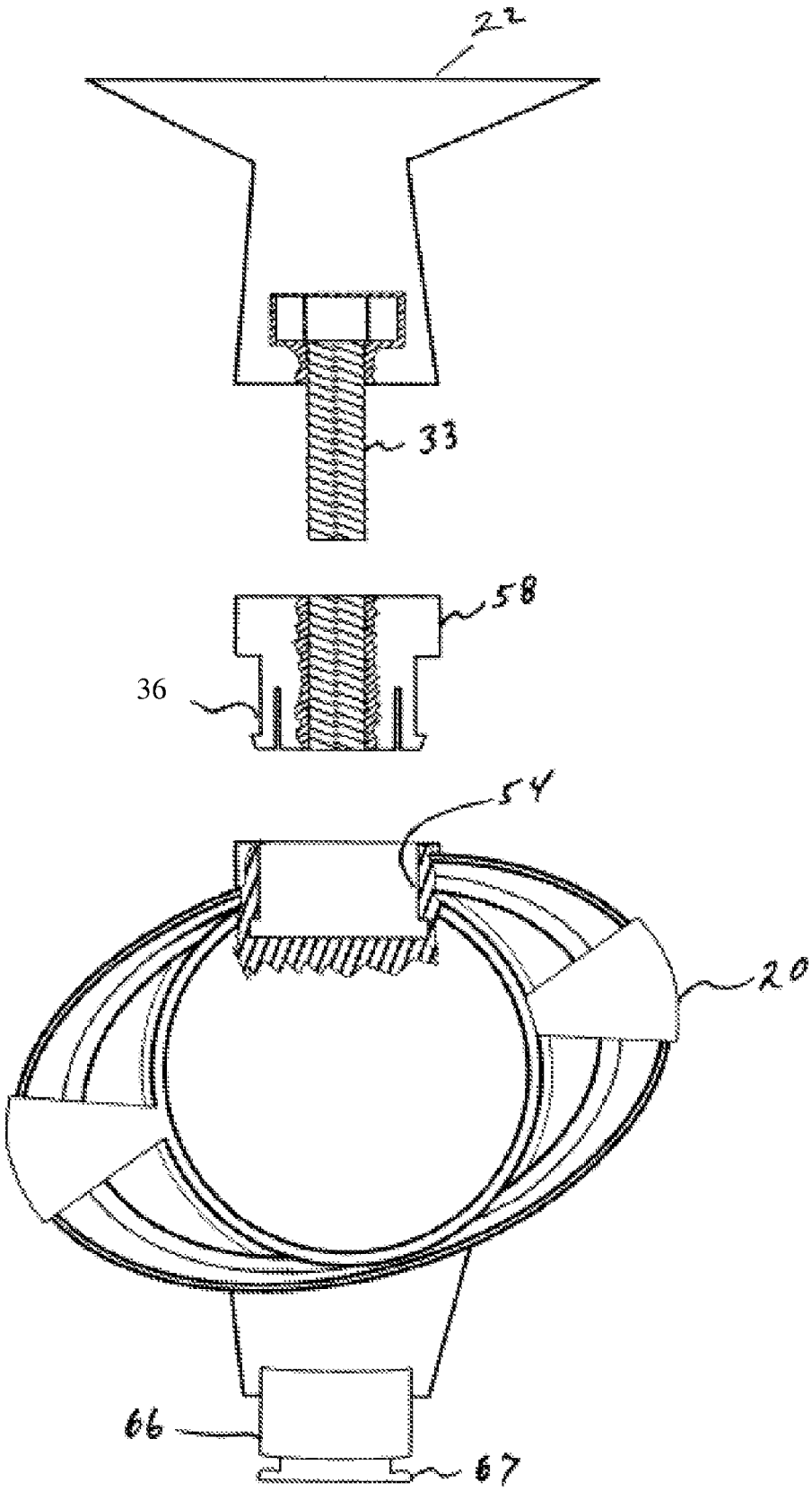

In the further alternative embodiments of FIGS. 11, 12 and 13, existing threaded components may be attached to trophy pre-assemblies of the present invention by utilizing an adapter 58 configured to be accepted in a connector base 34.

In this embodiment the connector base 34 includes a receptacle 44 to mate with adapter 58, and a central bore 56 to accept a nut 30, bolt 57 or ferrule 32. Thus the connector base 34 may be secured to a trophy assembly 10 by the traditional threaded rod 24 or by utilizing an adapter 58. In FIGS. 11 and 12, an adapter 58 is provided to enable a threaded figure 22, or other threaded component, to utilize the advantages of the present invention by adapting the threaded member 33 to engage a connector base 34 of the pre-assembled trophy. The adapter 58 comprising one or more resilient securing members 36 and a central threaded bore 62 to threadably receive a threaded member 33 from a trophy part, such as a figure 22.

Figure 15:
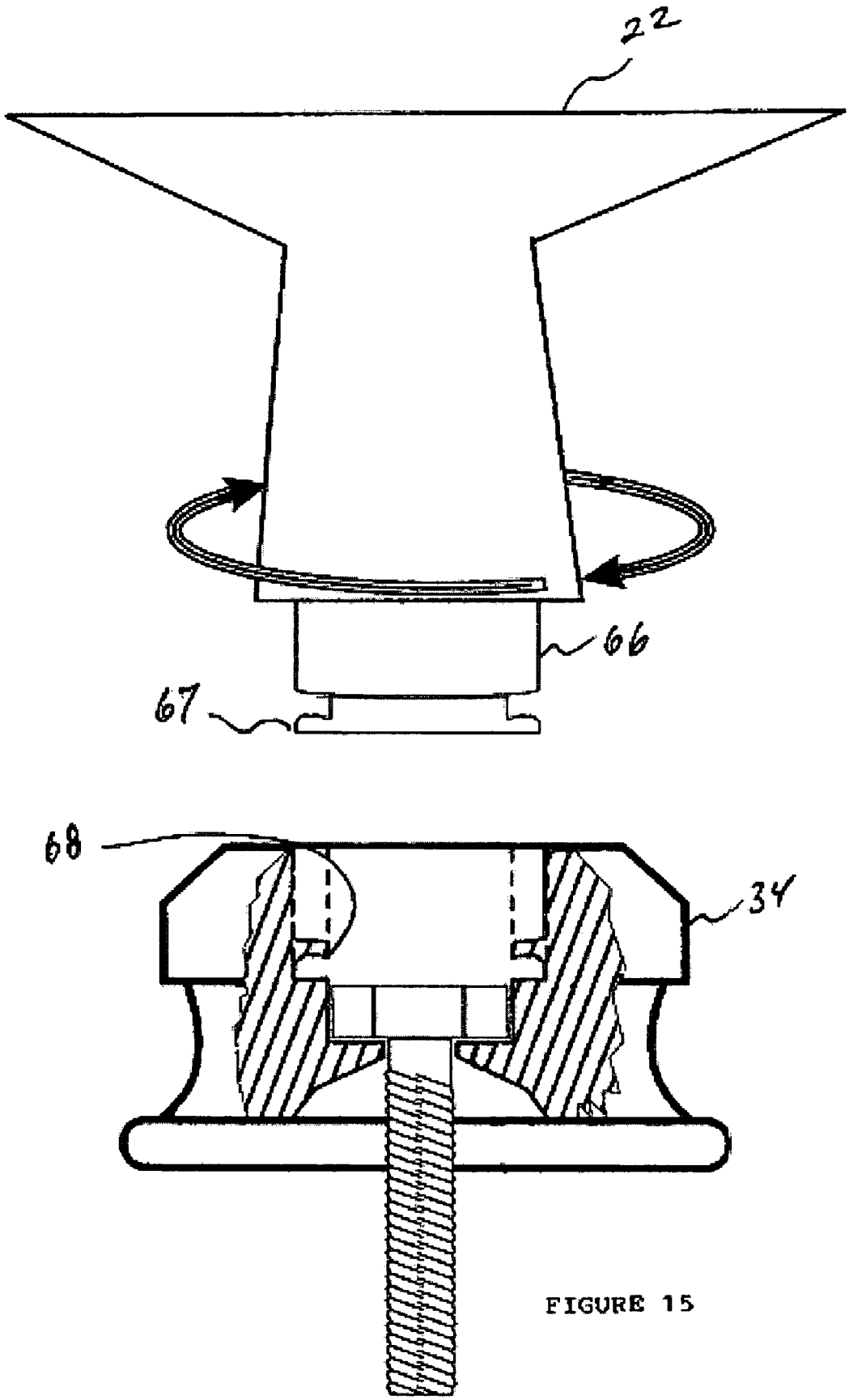

In the further embodiment of FIG. 13 the connector base 34 is replaced by a decorative riser 20 configured with a receptacle 54 to accept adapter 58. The riser 20 further configured with an engagement element 66. The engagement element 66 further comprising one or more engagement portions 67 attached thereto and configured to engage locking element 68 by an insert-and-twist motion, as illustrated in FIG. 15. In a further embodiment the figure 22 may be removed or replaced by reversing the twist motion thus enabling rapid changes of the award or figure 22. The twist-and-lock configuration may enable a more secure connection between the award 22 and the rest of the assembly, but also permits quick change of the award 22 if the customer desires.

Figure 14:
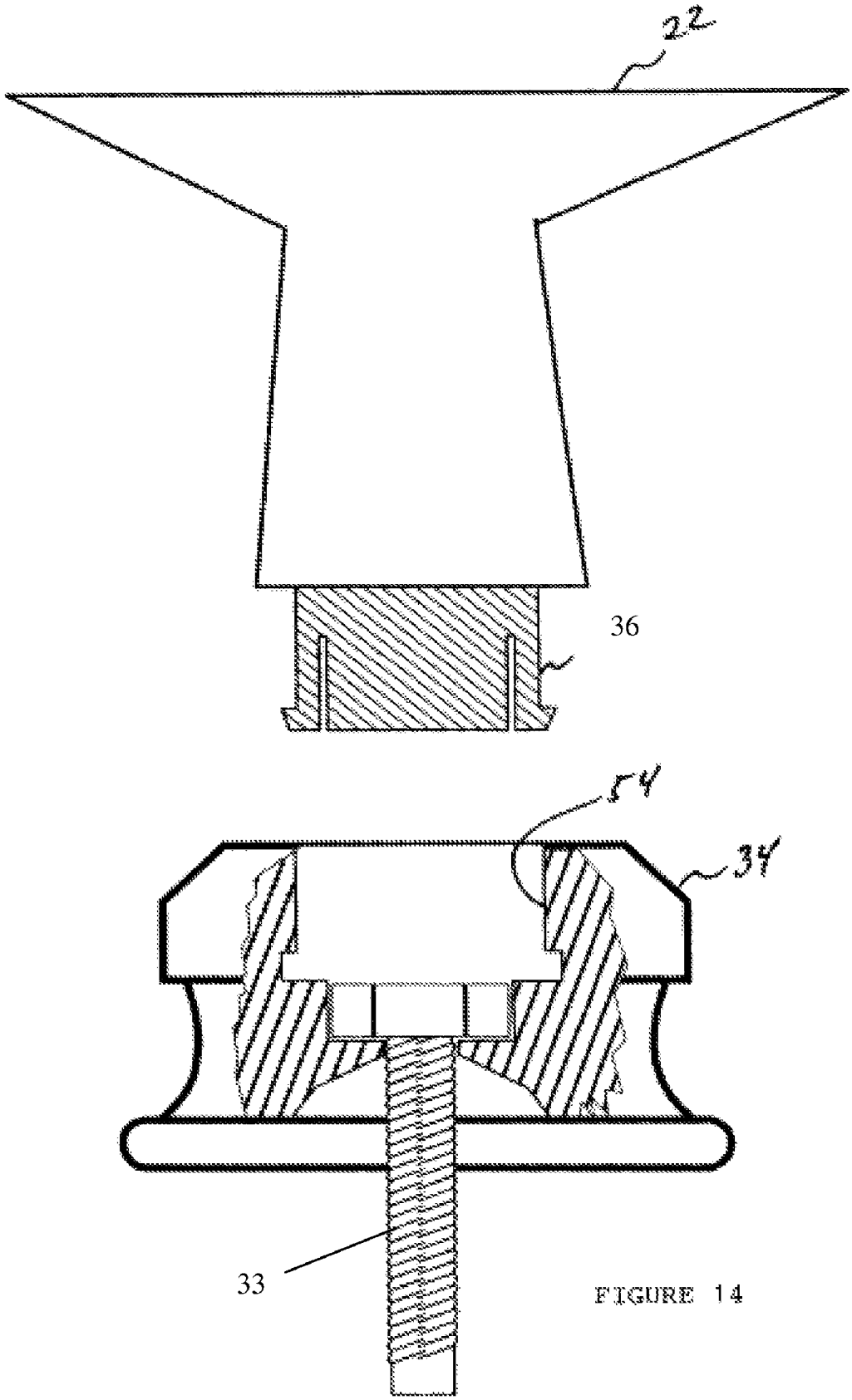
FIGS. 14 and 15 are perspective views showing embodiments of the snap and twist connecting members and connector base or riser.

In the further alternative embodiment of FIG. 14, the connector base 34 is engaged directly with the figure 22, configured with resilient locking fingers 60 for quick assembly.

In the further embodiment of FIG. 15, the connecting member 38 comprises an engagement element 66 with a plurality of engagement portions 67, and a locking element 68 of connector base 34 adapted to receive the engagement element 66 by an insert-and-twist motion, which may be reversible.

Figure 16:
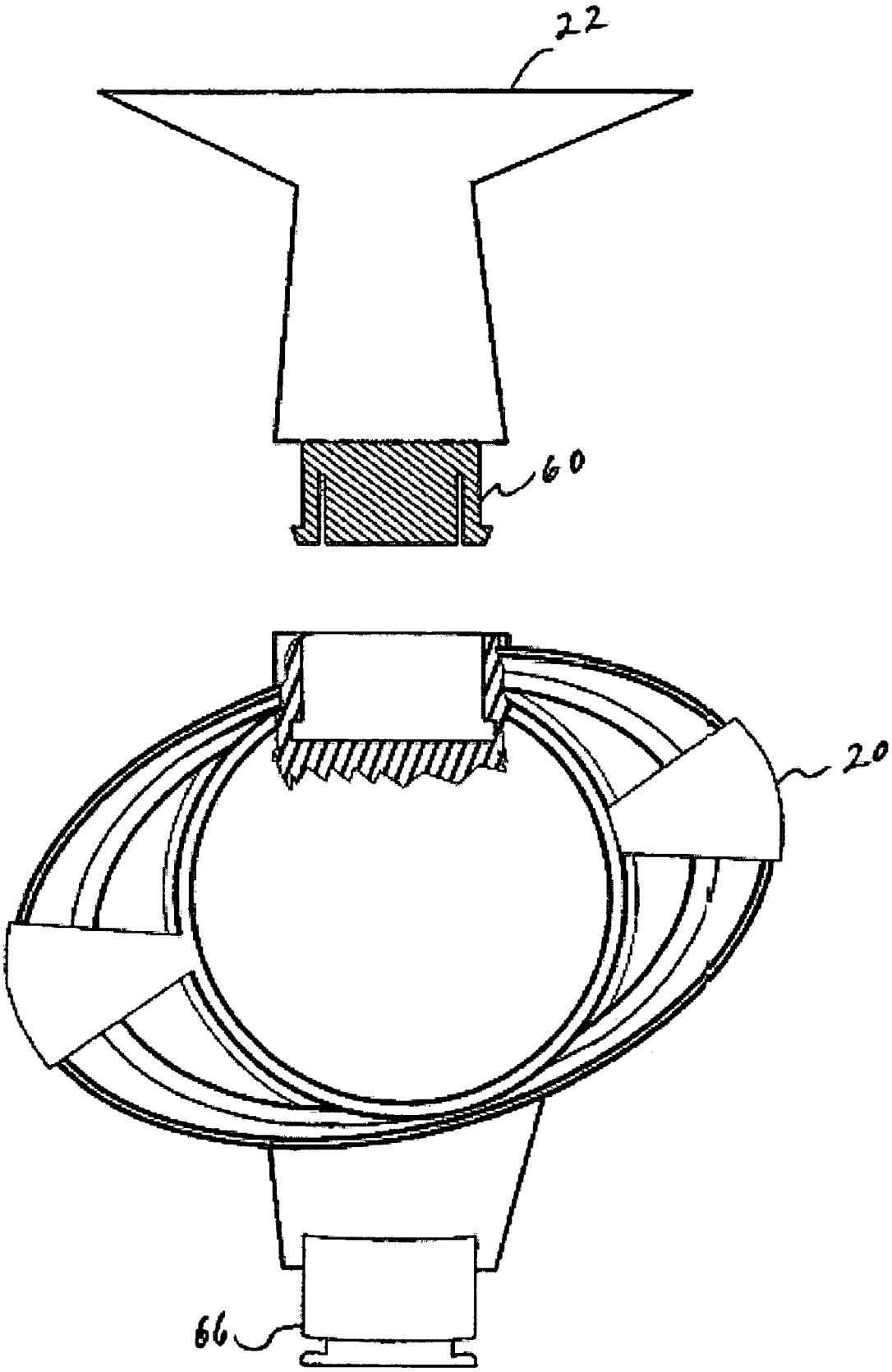
FIG. 16 is a perspective view an award with a snap connector and a riser with a twist and lock embodiment according to the present invention.

In the further embodiment of FIG. 16, the figure 22 further comprises one or more resilient securing members 36 to interconnect with riser 20, as shown in FIG. 14, and an engagement element 66 on the riser 20 to interconnect with a locking element 68, as shown in FIG. 15.

Figure 17:
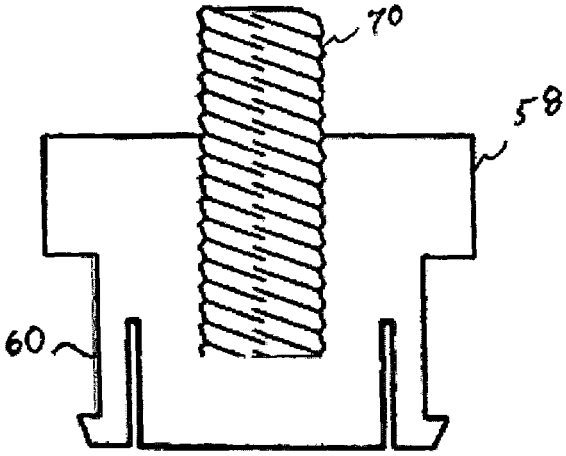
FIGS. 17 and 18 are sectional views of an embodiment of an adapter of the present invention providing the snap or twist configurations with a threaded rod or stud molded therein.
Figure 18:
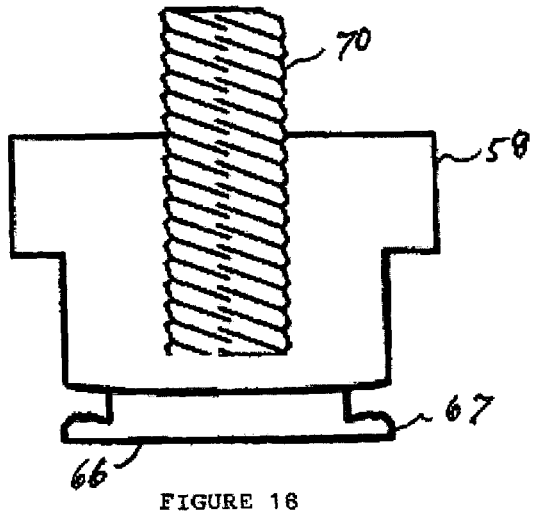
Figure 19:
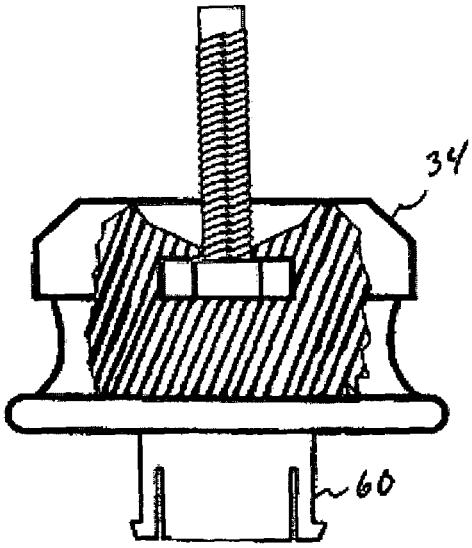
FIGS. 19 and 20 are sectional views of an embodiment of the connector base of the present invention providing a bolt molded therein and utilizing the snap or twist adapter.
Figure 20:
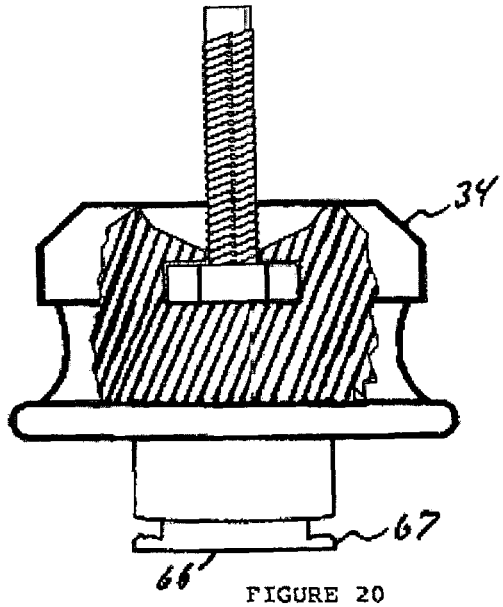
Figure 21:
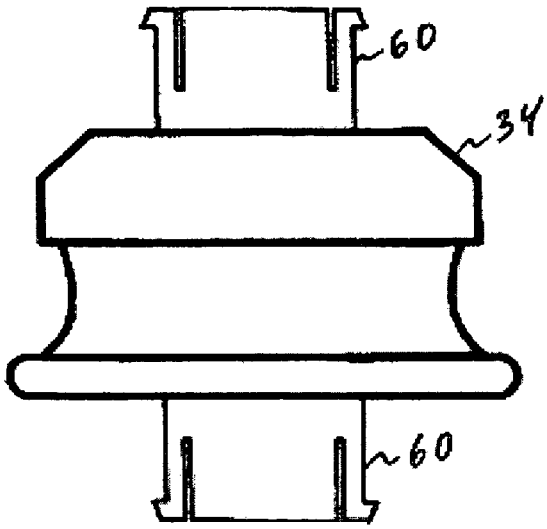
FIGS. 21 through 24 are perspective views of the connector base of the present invention providing various embodiments of the snap or twist adapters.

In the further embodiments of FIGS. 17 and 18, a threaded member 70 is molded or otherwise engaged in adapters 58, further comprising resilient locking fingers 60 or engagement elements 66 of the present invention. Such a configuration allows additional flexibility in construction of the trophy.

Similarly, the further embodiments of FIGS. 19 through 24 illustrate alternative configurations of the connector base 34. However, any component of the trophy assembly could be so adapted, in accord with the present invention.

Figure 25:
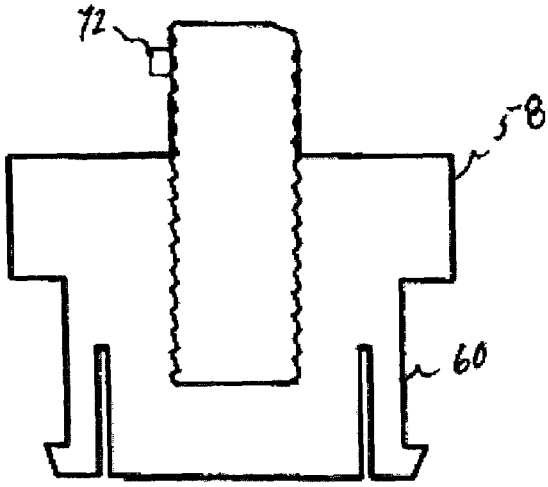
FIGS. 25 and 26 are sectional views of an embodiment of an adapter of the present invention providing the snap or twist configuration with one or more keys formed on a mounting stud to mate with a keyway in the adjacent trophy part.
Figure 26:
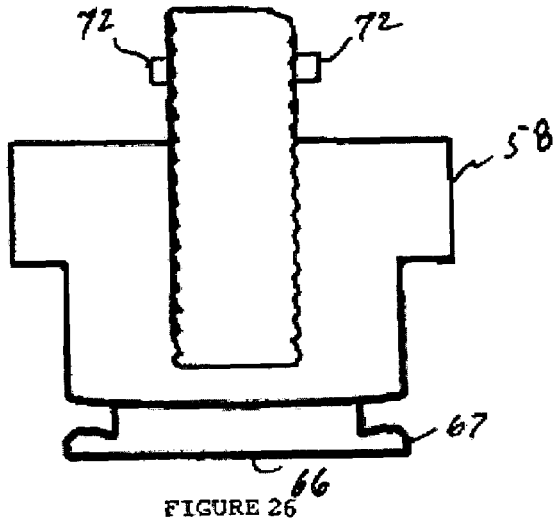

In the further embodiments of FIGS. 25 and 26, the threaded member 70 is replaced by connecting member 38 molded or otherwise engaged in adapters 58, further comprising one or more keys 72 molded thereon for engagement in an opening and keyway in the adjacent trophy component to secure the parts assembly. Such a connecting member 38 and key 72 may be constructed of substantially resilient or substantially rigid materials. Such a configuration allows additional flexibility in construction of the trophy in that the attachment may be configured to be permanent or reversible through a twist-and-engage or disengage configuration.

Figure 27:
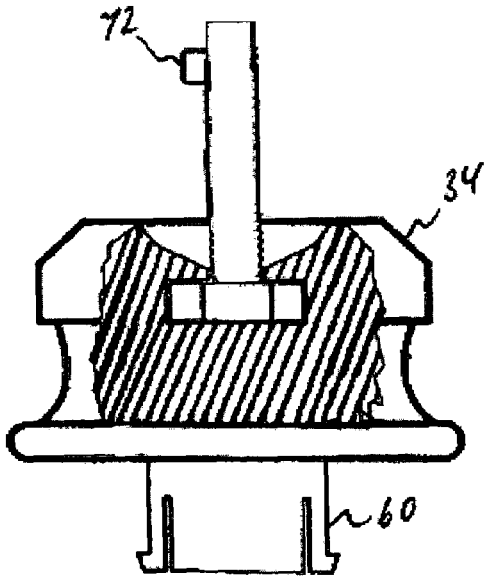
FIGS. 27 and 28 are sectional views of an embodiment of the connector base of the present invention utilizing the snap or twist connector and a bolt or stud molded therein exhibiting one or more keys formed on the stud to mate with a keyway in the adjacent trophy part.
Figure 28:
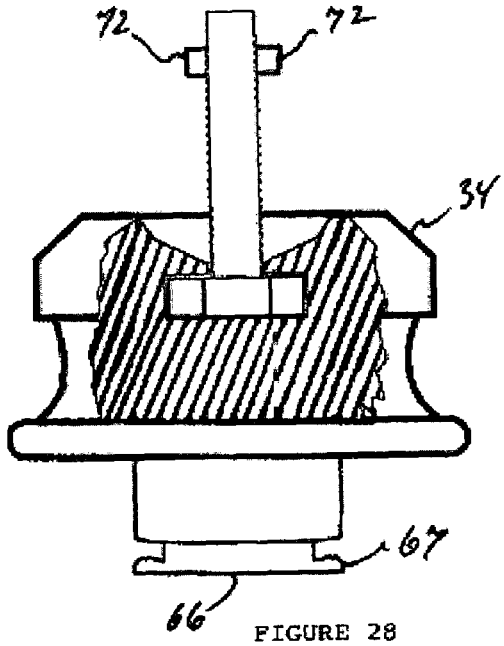

Similarly, the further embodiments of the connector base in FIGS. 27 and 28 illustrate alternative configurations of the attachment mechanism of FIGS. 25 and 26. However, any component of the trophy assembly could be so adapted, in accord with the present invention.

Those skilled in the art who have the benefit of this disclosure will recognize that certain changes can be made to the apparatus of the present invention without changing the manner in which those parts function to achieve their intended result, and any modifications which do not deviate from the scope of the invention are considered to be included therein.

For instance, it is most common that parts of a trophy are made from metal or plastics. Furthermore, due to the complex shapes now desired by consumers for trophy figures and decoration, for example the bike rider and riser in FIG. 5, it is preferable to use a plastic-like material that can be readily formed into such shapes in a mold or similar apparatus. Thus, connecting members 36 and their mating openings 44 may be formed onto the trophy component at the same time thereby taking advantage of the flexibility of the molded material.

The flexibility and integral connectedness imparts an advantage to both the connecting members 36 and the mating openings 44.

As shown in FIG. 3, the flexibility of the connecting members 36 allows them to deflect and be inserted into the openings 44, where the projecting portion 50 causes the connecting member 36 to deflect in the opposite direction longitudinally inwardly, and is thus engaged in said opening 44 by friction. If the configuration of the openings 44 allows the connecting member to pass through, then said member 36 will return to the pre-deflection state and said surface 52 of said projecting portion 50 will engage the bottom edge 45*a* of wall member 45*b* thereby securing the members in assembly.

By further incorporating the design of the connecting member 36 of FIG. 8, where the engagement surface 52 is substantially oblique from the surface of the connecting member, the members may thus be disengaged without need for time consuming disassembly of the entire trophy. This is a great advantage where it is desired by the retailer to rapidly interchange decorative elements or figures for the consumer.

In an alternative embodiment featuring a twist and lock configuration, components are adapted with a locking element 68 to receive an engagement element 66. The engagement element 66 and locking element 68 may configured to lock permanently or be further configured to reversibly engage, thereby allowing removal and replacement of components.

Rapid removal and replacement of a component of a trophy construction of the present invention is a major advancement in trophy construction and benefits consumers and retailers alike. For example, all too often a retailer receives a last-minute phone or e-mail order from a harried coach who needs to pick up ten trophies that afternoon for an award ceremony after a game. With the traditional threaded rod construction, all of the parts must be in inventory and the assembly of all the parts will take several hours, or as stated above possibly days. But utilizing the present invention, the retailer can carry several different preconstructed trophies at a lower inventory cost than a myriad of individual components. On order, only a figure needs to be attached at the top. In addition, one or more risers may be attached depending upon the desire of the customer. The coach runs into the store, on the way to the game, and discovers that the requested figure is not suitable, and demands a different figure. By the traditional threaded rod construction, every trophy would have to be disassembled, the original figure replaced, and the assembly realigned and tightened. Hours of work, but the coach cannot wait. So, the coach is forced to take the trophies, or do without, and the retailer has a dissatisfied customer. However, by using the teaching of the present invention of the replaceable components, the retailer can retreat to the store room, remove the figures and replace them with different figures in a few minutes. The coach is a satisfied customer and makes it to the game on time. Thus, trophy components configured by the teachings of the present invention would allow rapid replacement of any trophy component.

The connector base 34 of the present invention provides ability to use a nut, bolt, adapter 58 or other insert such as a ferrule 32, to connect to a threaded rod 24, or threaded member 33, such that the connector base 34 may be a universal connector for adaptation to threaded rod art construction. Thus the many variations of the connectors for the base 34 enable traditional threaded rod 24 construction to utilize the quick connect features on components, such as decorative risers 20 and figure 22, configured in accord with the teachings of the present invention.

Similarly, the use of flexible materials in the mating openings provides the advantage of a certain amount of elasticity when the connecting member 36 is inserted or removed. A further advantage of the use of flexible materials for the openings 44 is that connecting members 36 made out of substantially rigid materials, such as metals, will cause said opening 44 to deform when the rigid connecting member 36 is inserted therein and then substantially return to the predeformed state by virtue of the elasticity or flexibility of the material. Thus trophy members incorporating this attachment system retain their ability to be made from any variety of materials, not just flexible materials, as demanded by the consumer.

The foregoing description of the preferred embodiments of the invention has been presented for purposes of illustration and description. It is not intended to be exhaustive or to limit the invention to the precise form disclosed, and many modifications and variations are possible in light of the above teaching without deviating from the spirit and scope of the invention. The embodiment described is best selected to explain the principles of the invention and its practical application to thereby enable others skilled in the art to best utilize the invention in various embodiments and with various modifications as suited to the particular purpose contemplated.

All such changes, and others which will be clear to those skilled in the art from this description of the preferred embodiments of the invention, are intended to fall within the scope of the following, non-limiting claims.

What is claimed is:

1. A trophy construction for reliably engaging a trophy part comprising at least a connector base and a trophy figure mounted in operative association with said connector base, said construction comprising:

a. a connector base having an upper surface, a lower surface and a body;

b. disposed within said upper surface a securing member opening extending longitudinally in said body, said securing member opening comprising a wall member and a bottom edge;

c. said trophy figure comprising a connecting member and at least one resilient securing member comprising a first end, a second end, a projecting portion, a longitudinally-outward projecting camming surface formed at an acute angle to the plane of said connecting member, and an engagement surface formed at ninety degrees to the plane of said connecting member, d. said projecting camming surface adapted to engage said wall member and deflect said securing member longitudinally inwardly when longitudinal force is applied to said trophy figure, and e. said resilient securing member deflecting said engagement surface outwardly to reliably engage said bottom edge of said wall member within said securing member opening.

2. The trophy construction as set forth in claim 1, wherein said securing member opening of said connector base comprises a substantially resilient material.

3. The trophy construction as set forth in claim 1, wherein said securing member opening of said connector base comprises a substantially rigid material.

4. The trophy construction as set forth in claim 1, wherein said trophy figure comprises a decorative member.

5. The trophy construction as set forth in claim 1, wherein said trophy figure comprises a plurality of resilient securing members, and said connector base comprises a plurality of securing member openings.

6. The trophy construction as set forth in claim 1, wherein said connector base is a riser.

7. The trophy construction as set forth in claim 1, wherein said connector base is attached to a preassembled trophy unit.

8. A trophy construction for reversibly engaging a trophy part comprising at least a connector base and a trophy figure mounted in operative association with said connector base, said construction comprising:

a. a connector base having an upper surface, a lower surface and a body;

b. disposed within said upper surface a securing member opening extending longitudinally in said body, said securing member opening comprising a wall member and a bottom edge;

c. said trophy figure additionally comprising a connecting member and at least one resilient securing member comprising a first end, a second end, a projecting portion, a longitudinally-outward projecting first camming surface formed at an acute angle to the plane of said connecting member, an engagement surface formed at ninety degrees to the plane of said connecting member, and a second longitudinally projecting camming surface in association with said engagement surface, and formed at an angle greater than ninety degrees from the plane of said connecting member;

d. said projecting camming surface adapted to engage said wall member and deflect said securing member longitudinally inwardly when longitudinal force is applied to said trophy figure;

e. said resilient securing member deflecting said engagement surface outwardly to reliably engage said bottom edge of said wall member within said securing member opening; and f. said second camming surface adapted to deflect said resilient securing member inwardly to disengage said engagement surface from said bottom edge and from said securing member opening when upward longitudinal and transverse force is applied to said figure.

9. A method of assembly and disassembly of a trophy construction unit comprising the steps of:

a. providing a connector base having an upper surface, a lower surface and a body and disposed within said upper surface at least one securing member opening extending longitudinally in said body, said securing member opening comprising a wall member and a bottom edge;

b. providing a trophy figure comprising a connecting member and at least one resilient securing member comprising a first end, a second end, a projecting portion, a longitudinally-outward projecting first camming surface formed at an acute angle to the plane of said connecting member, an engagement surface formed at ninety degrees to the plane of said connecting member, and a second longitudinally projecting camming surface in association with said engagement surface, and formed at an angle greater then ninety degrees from the plane of said connecting member, and said projecting camming surface adapted to engage said wall member and deflect said securing member longitudinally inwardly when longitudinal force is applied to said trophy figure, and said resilient securing member deflecting said engagement surface outwardly to reliably engage said bottom edge of said wall member within said securing member opening; and said second camming surface adapted to deflect said resilient securing member inwardly to disengage said engagement surface from said bottom edge and from said securing member opening when upward longitudinal and transverse force is applied to said figure;

c. assembling said trophy construction by aligning said securing member with said securing member opening and exerting longitudinal force thereby deflecting and urging said resilient securing member into said securing member opening and reversibly engaging said bottom edge of said wall; and d. disassembling said trophy construction by exerting upward longitudinal and transverse forces to engage said second camming surface and disengaging said resilient securing member, and thereby said trophy figure, from said connector base.

10. A method of assembly and disassembly of a trophy construction unit wherein said trophy construction unit comprises an assembly using one or more components comprising connector bases and securing members of the present invention, said method comprising the steps of:

a. providing a connector base having an upper surface, a lower surface and a body and disposed within said upper surface at least one securing member opening extending longitudinally in said body, said securing member opening comprising a wall member and a bottom edge;

b. providing a trophy figure comprising a connecting member and at least one resilient securing member comprising a first end, a second end, a projecting portion, a longitudinally-outward projecting first camming surface formed at a substantially acute angle to the plane of said connecting member, an engagement surface formed at substantially ninety degrees to the plane of said connecting member, and a second longitudinally projecting camming surface in association with said engagement surface, and formed at an angle greater then ninety degrees from the plane of said connecting member, and said projecting camming surface adapted to engage said wall member and deflect said securing member longitudinally inwardly when longitudinal force is applied to said trophy figure, and said resilient securing member deflecting said engagement surface outwardly to reliably engage said bottom edge of said wall member within said securing member opening; and said second camming surface adapted to deflect said resilient securing member inwardly to disengage said engagement surface from said bottom edge and from said securing member opening when upward longitudinal and transverse force is applied to said figure;

c. assembling said trophy construction by aligning said securing member with said securing member opening and exerting longitudinal force thereby deflecting and urging said resilient securing member into said securing member opening and reversibly engaging said bottom edge of said wall; and d. disassembling said trophy construction by exerting upward longitudinal and transverse forces to engage said second camming surface and disengaging said resilient securing member, and thereby said trophy figure, from said connector base.

* * * * *